United States Patent [19]

Green, Jr. et al.

[11] Patent Number: 4,862,905

[45] Date of Patent: Sep. 5, 1989

[54] RODS CONTAINING PELLETIZED MATERIAL

[75] Inventors: Carl C. Green, Jr.; John D. Welch, both of Winston-Salem; Henry A. Hauser, Hamptonville; Diane R. Frye, King, all of N.C.

[73] Assignee: R. J. Reynolds Tobacco Company, Winston-Salem, N.C.

[21] Appl. No.: 61,507

[22] Filed: Jun. 15, 1987

[51] Int. Cl.[4] ..... A24C 5/60; A24C 5/50

[52] U.S. Cl. ..... 131/84.1; 131/331; 131/335; 493/39; 493/47; 493/48; 493/49

[58] Field of Search ..... 493/39, 47, 48, 49; 131/84.1, 280, 281, 337

[56] References Cited

U.S. PATENT DOCUMENTS

| | | |
|---|---|---|
| 2,682,270 | 6/1954 | Schur . |
| 2,815,760 | 12/1957 | Schreus et al. . |
| 3,153,362 | 10/1964 | Heijnis . |
| 3,162,199 | 12/1964 | Moll, Jr. . |
| 3,259,029 | 7/1966 | Hall et al. . |
| 3,297,038 | 1/1967 | Homburger . |
| 3,313,305 | 4/1967 | Noznick . |
| 3,313,306 | 4/1967 | Berger et al. . |
| 3,339,557 | 9/1967 | Karalus . |
| 3,339,558 | 9/1967 | Waterbury . |
| 3,354,886 | 11/1967 | Berger et al. . |
| 3,371,000 | 2/1968 | Davenport et al. . |
| 3,409,020 | 11/1968 | Westbrook, Jr. et al. . |
| 3,428,049 | 2/1969 | Leake et al. . |
| 3,446,404 | 5/1969 | Mehta . |
| 3,456,386 | 7/1969 | Holden . |
| 3,550,508 | 12/1970 | Wartman, Jr. et al. . |
| 3,570,557 | 3/1971 | Molins . |
| 3,589,371 | 6/1971 | Laporte . |
| 3,603,319 | 9/1971 | Badgett et al. . |
| 3,635,226 | 1/1972 | Horsewell et al. . |
| 3,656,518 | 4/1972 | Aronson . |
| 3,658,626 | 4/1972 | Berger et al. . |
| 3,685,521 | 8/1972 | Dock . |
| 3,743,528 | 7/1973 | Calleson . |
| 3,810,477 | 5/1974 | Berger et al. . |
| 3,837,264 | 9/1974 | Sexstone . |
| 3,844,200 | 10/1974 | Sexstone . |
| 3,847,064 | 11/1974 | Berger . |
| 3,884,741 | 5/1975 | Sexstone . |
| 3,910,166 | 10/1975 | Sexstone . |
| 3,943,940 | 3/1976 | Minami . |
| 3,957,563 | 5/1976 | Sexstone . |
| 3,972,335 | 8/1976 | Tiggelbeck et al. . |
| 3,991,773 | 11/1976 | Walker . |
| 4,005,668 | 2/1977 | Washington et al. . |
| 4,016,830 | 4/1977 | Sexstone . |
| 4,024,001 | 5/1977 | Lyon et al. . |
| 4,037,524 | 7/1977 | Hall . |

(List continued on next page.)

FOREIGN PATENT DOCUMENTS

| | | | |
|---|---|---|---|
| 1204018 | 9/1970 | United Kingdom | 131/337 |
| 1213897 | 11/1970 | United Kingdom . | |

OTHER PUBLICATIONS

Defensive Publication Ser. No. 775,576 to Hawkins et al., 3/69.

Defensive Publication T880009 to Harris, 11/69.

*Primary Examiner*—V. Millin

[57] ABSTRACT

Cigarette filter rods having individual pellets positioned at predetermined intervals therein are prepared by cutting a strand of plasticized material into pellets which are then inserted into a web of filter tow. A wheel having a series of grooves is rotated within a rim-like housing, and introduction of a plasticized flavor-containing strand into each groove results in a cutting of the strand into pellets of the desired size. Each pellet is positioned within the moving web of tow. The web filter material and the pellets positioned within the web are introduced into a rod-making unit wherein the rod is formed. The rate of feed of the strand, the rate of feed of the filter tow, the rate of rotation of the grooved wheel and the rate of pellet formation are controlled relative to one another such that pellets of well controlled size are positioned at predetermined intervals along the rod. Cigarette filter elements having well controlled amounts of flavorant contained therein can be made from the rods.

29 Claims, 5 Drawing Sheets

U.S. PATENT DOCUMENTS 4,044,640 8/1977 Gokyu .
4,064,791 12/1977 Berger .
4,109,666 9/1978 Norman et al. .
4,214,508 7/1980 Washington .
4,281,671 8/1981 Bynre et al. .
4,300,576 11/1981 van der Loo et al. .
4,311,156 1/1982 Bonnet et al. .
4,318,417 3/1982 Hiroshi et al. .
4,411,640 10/1983 Hall .
4,412,829 11/1983 Lebet et al. .
4,425,107 1/1984 Hall .
4,466,451 8/1984 Bonnet et al. .
4,476,807 10/1984 Pryor .
4,525,385 6/1985 Pryor .
4,549,875 10/1985 Pryor .
4,598,720 7/1986 Gabriel .
4,608,115 8/1986 Schroth et al. .
4,677,995 7/1987 Kallianos et al. .
4,703,868 11/1987 Shaw .

RODS CONTAINING PELLETIZED MATERIAL

BACKGROUND OF THE INVENTION

The present invention relates to the manufacture of rods such as are useful for the manufacture of filter elements for smoking articles, and in particular, to filter rods having pelletized materials spaced at predetermined intervals therein.

Popular smoking articles such as cigarettes have a substantially cylindrical rod shaped structure and include a charge of smokable material such as shredded tobacco (e.g., cut filler) surrounded by a paper wrapper thereby forming a so-called "tobacco rod." It has become desirable to manufacture cigarettes having cylindrical filter elements aligned in an end-to-end relationship with the tobacco rod. Typically, filter elements are manufactured from fibrous materials such as cellulose acetate tow which is circumscribed by plug wrap. The filter element is attached to the tobacco rod using a circumscribing tipping material. The filter elements generally are provided from so called "filter rods."

Apparatus and methods for providing a cigarette filter rod containing a smoke modifying agent are proposed by Pryor in U.S. Pat. Nos. 4,549,875; 4,525,385 and 4,476,807. Another type of cigarette filter rod having a continuous flavored thread incorporated therein or wrapped in flavored tape is proposed by Bynre et al in U.S. Pat. No. 4,281,671. Still other apparatus and methods for manufacturing filter rods having particulate or granular smoke modifying material dispensed therein are proposed by Sexstone in U.S. Pat. Nos. 3,884,741; 3,884,200; 3,957,563 and 4,016,830.

It would be highly desirable to provide an apparatus and method for manufacturing cigarette filter rods having well controlled amounts of smoke modifying agent therein.

SUMMARY OF THE INVENTION

This invention relates to rods for use in the manufacture of smoking articles such as cigarettes, wherein each rod has solid masses comprising aerosol modifying material individually spaced at predetermined intervals along the length thereof. Such rods can be manufactured in a continuous manner using an apparatus having means for providing a continuous supply or stream of rod filler material; means for continuously inserting the individual solid masses comprising aerosol modifying material at predetermined intervals within the stream of filler material so supplied; means for forming a continuous rod having the individual solid masses positioned at predetermined intervals within the rod; and means for subdividing the continuous rod at predetermined intervals.

As used herein, the term "rod filler material" is meant to refer to the material which provides the majority of the volume of the rod; as for example, the filter material (e.g., cellulose acetate tow) of a filter rod.

More particularly, the present invention relates to an apparatus for providing rods such as filter rods for use in the manufacture of smoking articles such as cigarettes. The apparatus includes a means for supplying a continuous supply of rod filler material such as a continuous web of filter material from a source of such material (e.g., a bale, bobbin, or the like). The apparatus also includes a means for supplying a continuous strand (e.g., a bobbin of thermoplastic strand) which is employed to provide the pelletized material. The apparatus further includes a pellet insertion unit for continuously forming pellets from the strand and inserting or depositing the individual pellets at predetermined intervals within the filler material so supplied (e.g., within the web of filter material).

The pellet insertion unit includes a circular rotatable member (e.g., a wheel) having a series of grooves or pockets positioned at predetermined intervals along the periphery of the rotatable wheel, and a retaining means (e.g., ledger housing) including a strand inlet means for allowing introduction of the strand to successive pockets along the periphery of the wheel. The wheel and retaining means are arranged such that (i) the interaction thereof causes the strand to be subdivided into pelletized form within each individual successive pocket, and (ii) the individual pellets are maintained within the respective pockets until each pellet is deposited within the filler material so supplied. The apparatus further includes means for controlling the rate of supply of strand, the rate of rotation of the wheel, and the rate of supply of filler material such that the pellets are positioned at predetermined intervals within the stream of filler material (e.g., within the web of filter material).

The filler material having each pellet deposited therein is received into a rod-making means for providing a continuous rod. The continuous rod is subdivided into the desired length at predetermined intervals such that the desired number of individual pellets are positioned within the individual subdivided segments (e.g., four pellets can be positioned within a rod segment or filter rod thus providing a "four up" rod).

As used herein, the term "pellet" refers to an essentially solid mass which has a spherical, cubic, cylindrical, or other such shape; and in particular to a solid mass of a defined, controlled size and weight. Of particular interest are pellets having an essentially cylindrical shape which are prepared from the controlled cutting of a strand of plasticized material.

The use of the apparatus provides the skilled artisan with an efficient and effective method for manufacturing rods such as filter rods for use in the manufacture of smoking articles such as cigarettes. Particularly preferred rods have filter material contained within a circumscribing outer wrap and the individual pellets are spaced within the rods at predetermined intervals along each rod. In particular, such filter rods can be employed as filter elements for cigarettes wherein each filter element has a pellet positioned therewithin. If desired, two or more pellets can be individually positioned at desired intervals within each filter element.

Of particular interest are pellets which include, carry or contain a smoke modifying agent such as a flavorant. In such a manner, aerosol such as tobacco smoke which travels through the filter element of the smoking article during draw can have flavorant entrained in that aerosol.

The rods provided according to this invention can have a well controlled, consistent amount of smoke modifying agent positioned with relative ease at predetermined intervals along the length of each rod. For example, the amount or type of smoke modifying agent carried or contained by a particular strand can be varied while the manner or process for making the ultimate rod is held essentially constant. Rods of this invention having the individual pellets of controlled size positioned at predetermined intervals therein are of highly consistent quality as compared to rods having metered amounts of granular materials positioned therein. In addition, the quality of the rods can be well controlled, as electronic inspection of the rods can easily provide for detection of either the presence or absence of a pellet at the desired interval within each rod.

DETAILED DESCRIPTION OF THE PREFERRED EMBODIMENTS

Figure 1:
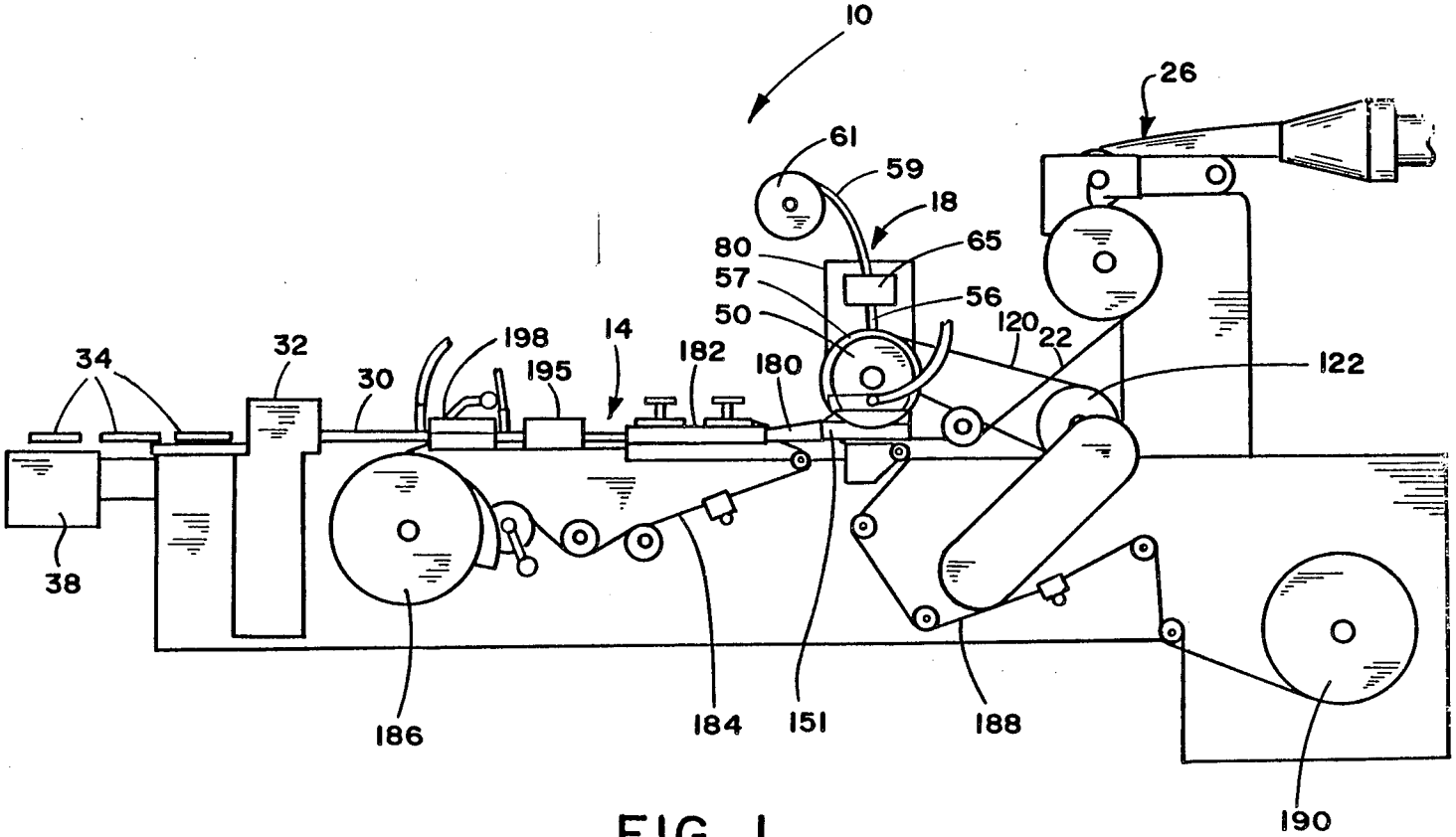
FIG. 1 is a diagrammatic illustration of one embodiment of the rod-making apparatus including a portion of the filter tow processing unit, the source of strand for providing the pelletized material, the pellet insertion unit, and the rod-forming unit.

Referring to FIG. 1, an exemplary rod-making apparatus 10 includes a rod-making unit 14 and a pellet insertion unit 18 for placing pelletized material at predetermined intervals within a continuous length of filter material 22. The continuous length of filter material is supplied from a source (not shown) such as a storage bale, bobbin, or the like. Generally, the filter material is processed using a filter material processing unit 26. The continuous length of filter material 22 which has pelletized material incorporated therein at predetermined, spaced intervals is passed through the rod-forming unit 14 thereby forming a continuous rod 30, which can be subdivided by severing means 32 into a plurality of rods 34 which are collected using tray 38 or other suitable collection means.

The pellet insertion unit 18 includes a rotatable member 50 having the shape of a wheel which is held in place within a ledger housing 57. The pellet insertion unit also includes a tube 56 or other means for feeding or otherwise providing a passageway for continuous strand 59 into the ledger housing. The continuous strand is fed from a bobbin 61, or other means such as a coil.

Figure 2:
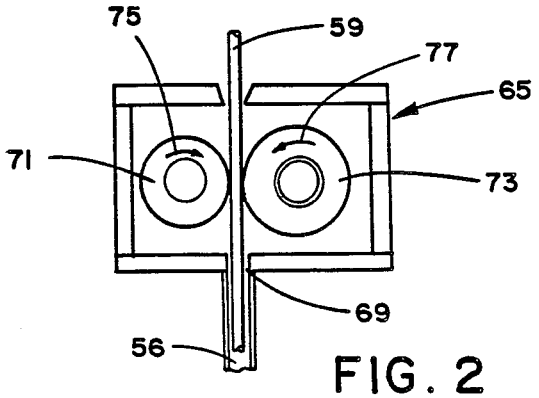
FIG. 2 is an enlarged sectional illustration of a portion of the pellet insertion unit.

Referring to FIG. 2, strand 59 is pulled into strand drive assembly 65 which includes inlet opening 67, outlet opening 69 into tube 56, and drive assembly including metering roller 71 and pressure roller 73. The metering roller 71 and the pressure roller 73 are rotated in opposite directions as shown by arrows 75 and 77, respectively, such that the strand is pulled and then driven into the tube 56.

Typically, the metering roller 71 has a knurled surface and is manufactured from cold rolled steel, or other suitable material. The pressure roller 73 can be manufactured from resilient rubber or any other suitable material. The relative speed of the two rollers can be preset in order to control the rate at which strand 59 is fed into tube 56. A suitable gear assembly (not shown) for providing rotation of the metering roller (and both the metering roller and pressure roller, if desired) will be apparent to the skilled artisan.

Figure 3:
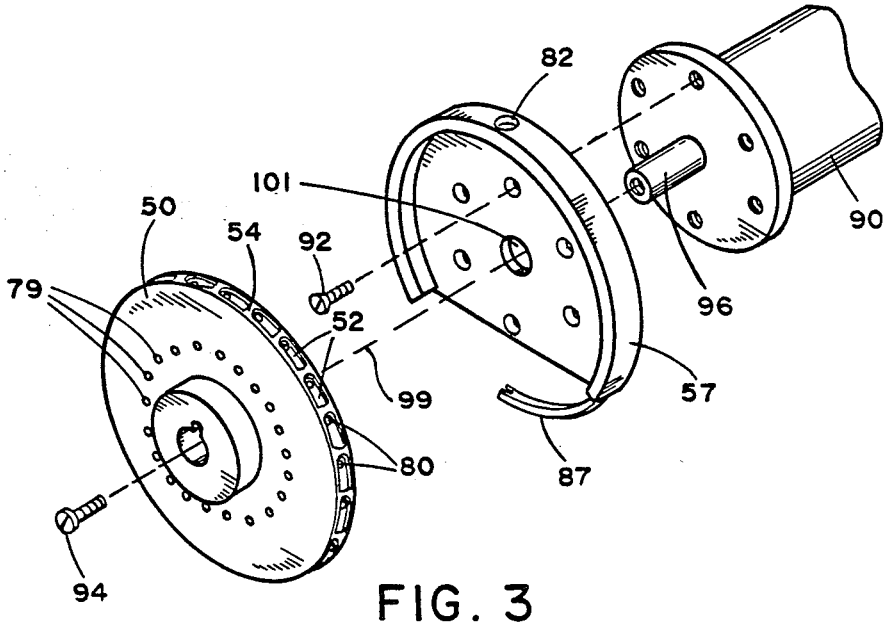
FIG. 3 is an exploded perspective of the separated elements of a portion of the pellet insertion unit.

Referring to FIG. 3, the pellet insertion unit includes a rotatable wheel 50 having a series of grooves or pockets 52 positioned at predetermined intervals along the periphery 54 thereof. The series of grooves 52 which are positioned along the peripheral face 54 of the wheel are at equally spaced intervals. The number of grooves present in the face of the wheel generally is dependent upon the manner in which the strand is introduced to the pocket, the rate of rotation of the wheel relative to the rate of feed of filter material, and the desired spacing of the individual pellets within the filter rod. For example, a wheel of about 5.3 inch diameter can have 20 grooves, the centers of which are equally spaced at a 21 mm distance. As another example, a wheel of about 5.4 inch diameter can have 14 grooves, the centers of which are equally spaced at 31 mm distance. The width of each groove is less than the width of the face 54 of the wheel, and typically is determined by the diameter of the continuous strand which enters the groove (i.e., the width of the groove is greater than the diameter of the strand). The depth of the groove is dependent upon the desired length of pellet. The wheel 50 is manufactured from pre-tempered, cold-rolled steel, or the like.

The width of wheel 50 is predetermined according to factors such as the circumference of the continuous rod which is manufactured according to this invention and the diameter of the continuous strand which is employed. Generally, the width of the wheel is the width of the peripheral face 54 of the wheel. Of particular interest is a wheel having a width of about 0.25 inch. A wheel with such a width can conveniently be used for the manufacturing of rods having a circumference of about 25 mm. The diameter of the wheel 50 can vary. Typically, the diameter of the wheel is dictated by factors such as the shape, spacing and number of pockets in the peripheral face thereof, and the rate at which the wheel is required to rotate. For most applications involving the manufacture of filter rods for smoking articles, the diameter of the wheel preferably ranges from about 4 inches to about 8 inches.

A series of perforations 79 are positioned about the side face of wheel 50. The perforations each extend as passageways within and through the wheel, and exit through the peripheral face of the wheel as perforations 80 within grooves 52. Thus, individual passageways from the side of the wheel to the bottom face of each groove are provided for assisting in the removal of the pellet from the groove at desired time (as discussed in detail hereinafter).

The ledger housing 57 is positioned as a rim over the peripheral face 54 of the wheel 50 and is spaced from the wheel such that the wheel can rotate freely therein. An opening or passageway 82 through the upper peripheral face of the ledger housing provides a means for the insertion or introduction of strand into the successive pockets along the periphery of the wheel 50 (as discussed in detail hereinafter). A typical passageway 82 has a diameter which approximates the width of the groove, and generally is about 3 mm. The ledger housing extends over the peripheral face of the wheel 50 to near that region where the pellet can be conveniently removed from the groove 52 and positioned within the filter material (as discussed in detail hereinafter). Typically, the face of the wheel 50 is not covered by the ledger housing 57 in the region where the pellet is released from the groove. Preferably, the ledger housing provides a plow or shoe 87 to part or separate the web of filter material to ensure that the pellet is well positioned within the material (as discussed in detail hereinafter). The ledger housing is manufactured from pretempered, cold-rolled steel, or the like.

The wheel 50 is positioned within the ledger housing 57, and the two components are supported by housing support 90. The ledger housing is secured to the housing support by bolts 92, or other suitable fastening means. The wheel is secured for rotation within the ledger housing by bolt 94, or other suitable fastening means, which is threaded into the axle-like rotatable support shaft 96 of the housing support 90. In such a manner the wheel can be rotated about its axis of rotation (shown as dotted line 99 in FIG. 3). In particular, the rotatable support shaft 96 extends through opening 101 in the ledger housing to be positioned in contact with the wheel 50 in order that rotation of the shaft will provide rotation of the wheel (i.e., act as a drive shaft for the wheel).

Figure 4:
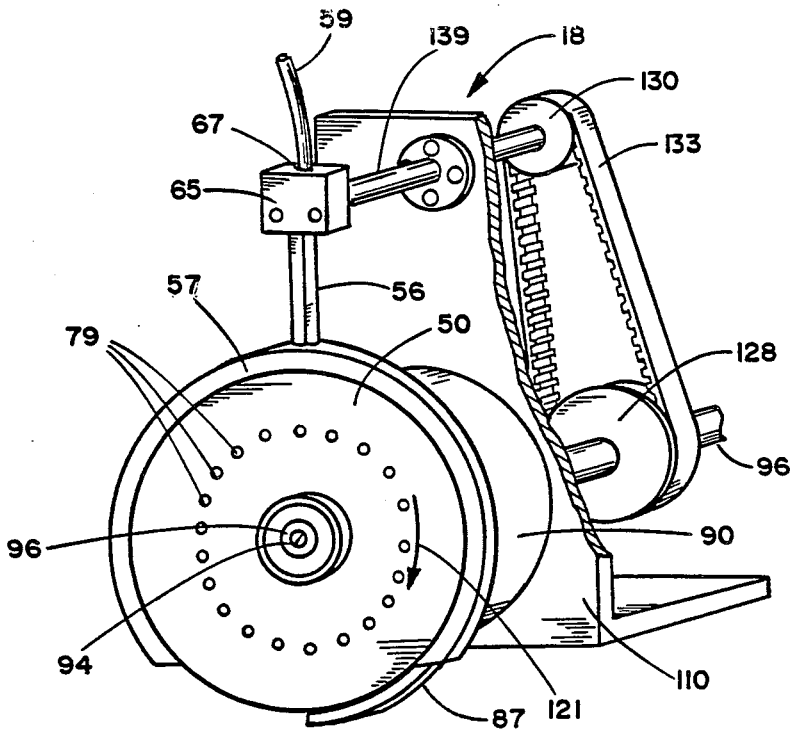
FIG. 4 is an enlarged perspective of the pellet insertion unit with a portion of the frame thereof shown as partially cut away.

Referring to FIG. 4, strand drive assembly 65, wheel 50, ledger housing 57 and housing support 90 are supported by frame 110 (which is shown as partially cut away). The frame 110 provides for secure positioning of the pellet insertion unit relative to the rod-making unit.

Rotation of the drive shaft 96 is provided by a pulley, gear assembly, or other type of drive means (not shown) which is driven by belt 120 (shown in FIG. 1) or other such means. Rotation of drive shaft 96 causes rotation of wheel 50 in the direction shown by arrow 121. The belt 120 which is used to provide rotation of drive shaft 96 is driven by pulley 122 or other suitable drive means (shown in FIG. 1). Pulley 122 is in turn driven by the rod making unit. A suitable assembly for providing rotation of drive shaft 96 at a rate related to or controlled by the drive mechanism of the rod-making unit will be apparent to the skilled artisan.

Rotation of the drive shaft 96 causes a rotation of pulley 128 or other suitable drive means. As shown in FIG. 4, pulley 128 is positioned on drive shaft 96, and the rotation of pulley 128 causes rotation of pulley 130 by way of belt 133. The rotation of pulley 130 provides a means for driving shaft 139. Shaft 139 provides for the rotation of metering roller 71 within strand drive assembly 65 (see FIG. 2). In such a manner, the rate of supply of web of filter material, the rate of rotation of the wheel of the pellet insertion unit and the rate of supply of strand can be controlled such that the pellets which are formed are positioned at the desired, predetermined intervals within the web of filter material. In particular, the rate of feed of strand through the drive assembly 65, the formation of the pelletized material within each groove 52, the rate of rotation of the wheel 50, and subsequent positioning of the pellets within the resulting filter rod are synchronized with respect to the rate at which the filter material 22 is fed into the rod-forming unit 14. Other suitable configurations for providing a control of the feed of strand, rotation of wheel and feed of filter material may be apparent to the skilled artisan.

Figure 5:
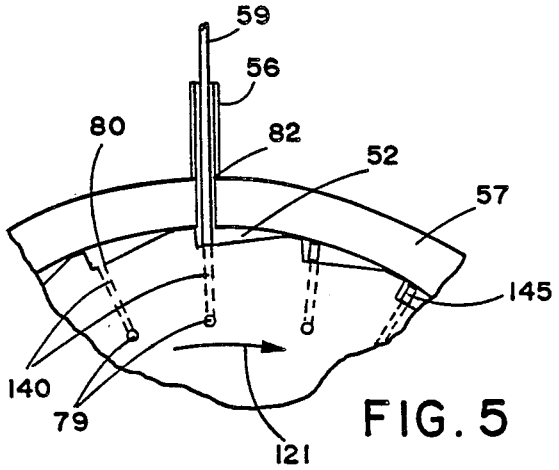
FIG. 5 is an enlarged sectional illustration of a portion of the pellet insertion unit.

Referring to FIG. 5, wheel 50 is rotated in the direction shown by arrow 121. The wheel has a series of perforations 79 through the side face thereof. Each perforation 79 extends into the wheel thereby forming passageways 140 which exit as perforations 80 in the bottom face of the respective grooves 52. The wheel 50 is positioned with the rim-like ledger housing 57 so that the wheel can rotate freely therein. The ledger housing includes passageway 82 which extends through the upper peripheral face thereof in order that strand 59 can be inserted into the groove 52 of the wheel 50. The perforations 79 and 80, and passageways 82 each preferably have circular cross sectional shapes, and diameters of about 1/16 inch. The strand 59 is fed through tube 56 (shown as partially cut away) from the drive assembly at a predetermined rate (as discussed previously).

The wheel and ledger housing are arranged such that the interaction thereof causes the strand to be subdivided into pelletized form thereby forming pellet 145 within each individual successive pocket. In particular, the rate of feed of strand, the rate of rotation of the wheel, the depth of the groove and the length of the groove are such that the strand can be fed into the groove and sheared to form pellet 145 of the desired size. Preferably, each groove is generally wedge-shaped along the length thereof, wherein the depth of the groove extends from shallow to its maximum depth. In addition, the positioning of the grooves and the rotation of the wheel are such that the strand first enters the groove through passageway 82 in the ledger housing into the shallow portion of the groove, and then the strand is sheared to form pellet 145 when the foremost end of the strand approaches reaching the deep portion of the groove. Representative grooves have lengths (as measured from the deepest portion of a groove to the deepest portion of an adjacent groove) of about 20 mm to about 35 mm; and maximum depths of about 2.5 mm.

Each generally wedge-shaped groove preferably has an abrupt surface extending from the deepest portion of the groove towards the periphery of the wheel. In such a manner, the rotating wheel and ledger housing can interact such that the strand which extends into the groove can be sheared into the desired size thereby forming pellet 145. Such a cutting action is provided as a result of close spacing of the inner face of the ledger housing relative to the outer face of the wheel, and the relatively small diameter of the passageway 82. In particular, the strand is forced against the back face of the groove, and the resulting close spacing of the groove and the ledger housing acts to cut the strand into the form of a pellet. After a pellet is formed, the strand is fed into the successive groove. In such a manner, continuous formation of pellets is effected.

The individual pellets 145 remain well positioned in each respective groove until the insertion of the pellet into the web of filter material is desired. In particular, the rim-like nature of the ledger housing 57 and plow 87 relative each groove 52, and the relative close spacing of the inner surface of the ledger housing and plow relative to the outer face of the groove allows each individual pellet to be maintained within the respective groove, preferably without moving longitudinally within the groove, until each pellet is deposited within the web of filter material.

Figure 6:
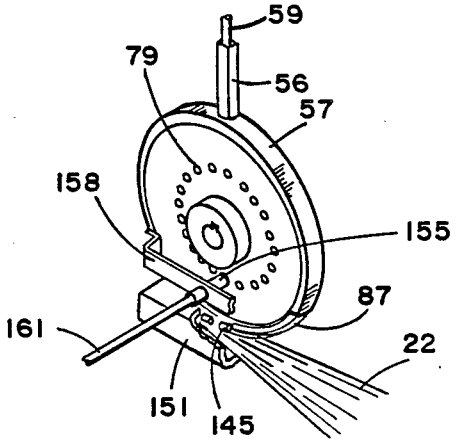
FIG. 6 is an enlarged perspective of a portion of the pellet insertion unit.

Referring to FIG. 6, the continuous web of filter material 22 is fed into guide or block 151 (shown as partially cut away). The guide 151 receives the wide band of filter material, and gradually forms the web into a composite which generally resembles a cylindrical composite. The plow 87 of the ledger housing separates or spreads the filter material such that the pellet 145 is positioned or placed at the desired location within the web of filter material. When the tow reaches the endmost portion of the plow, the motion of the tow acts to close itself into a cylindrical composite which contains the individual pellets at the desired locations therein. A suitable plow has a maximum depth of about 0.25 inch.

The pellet is maintained within a groove until the location at which the ledger housing does not cover the wheel as a rim, at which point the pellet is inserted into the web of filter material. Typically, the pellet falls (i.e., is rejected) from the groove and into the web by the action of gravity.

Rejection of each pellet at the desired location can be assured by air jet 155 or other suitable means which can act as a nozzle. In particular, the nozzle 155 is positioned so as to force air into perforation 79 along the side face of wheel 50 which in turn exits the previously described perforation in the bottom of the groove. In such a manner, the action of gravity is assisted and the pellet is forced from the selected groove into the web of filter material at the desired location. The nozzle 155 is held in place so as to be in registry with the desired perforation 79 in the side face of wheel 50 by frame 158 (shown as partially cut away). The air is received from a source (not shown) such as a laboratory air supply through tube 161, or other suitable means. Other techniques for assuring removal of each pellet from each groove at the desired location (e.g., the use of mechanical or pneumatic plungers) may be apparent to the skilled artisan.

Figure 7:
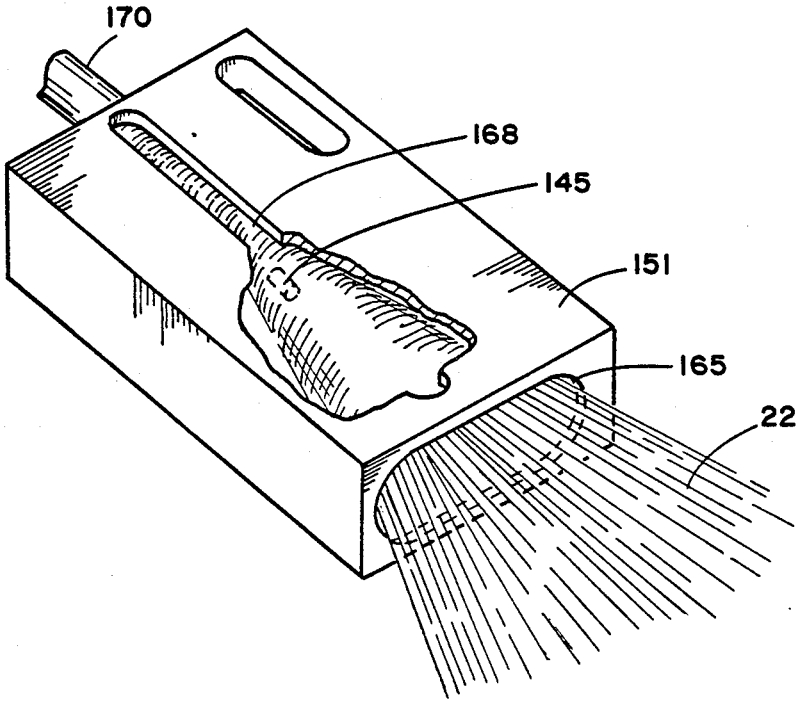
FIG. 7 is an enlarged perspective of a portion of the pellet insertion unit showing filter tow and the position of placement of a pellet within the filter material.

Referring to FIG. 7, the guide or block 151 (the top portion of which is shown as partially cut away) has a relatively wide opening 165 at one end in order that the filter material 22 can be fed therein. A suitable wide opening is about 0.5 inch high and about 2.5 inches in width. A suitable block has a length of about 5.5 inches. The shape of the hollow inner portion of the block is such that the filter material is formed into a composite which more generally resembles a cylinder. A suitable composite is about 9/16 inch in diameter. In particular, the inner portion of the block 151 is a hollow region or cavity in order that the filter material can be passed therethrough. The block has a longitudinally extending slot 168 along the top portion thereof in order to allow the rotating wheel and ledger housing (not shown) to extend into the web of filter material and to insert pellet 145 at the desired location therein. A suitable slot is about 4 inches long for a block having a length of about 5.5 inches. In a suitable situation, the plow extends into the slot so as to extend about ⅛ inch from the extreme bottom portion of the hollow inner portion of the block. The cylindrical composite 170 is received by the receiving means of the rod-making unit (as discussed hereinafter).

Figure 8:
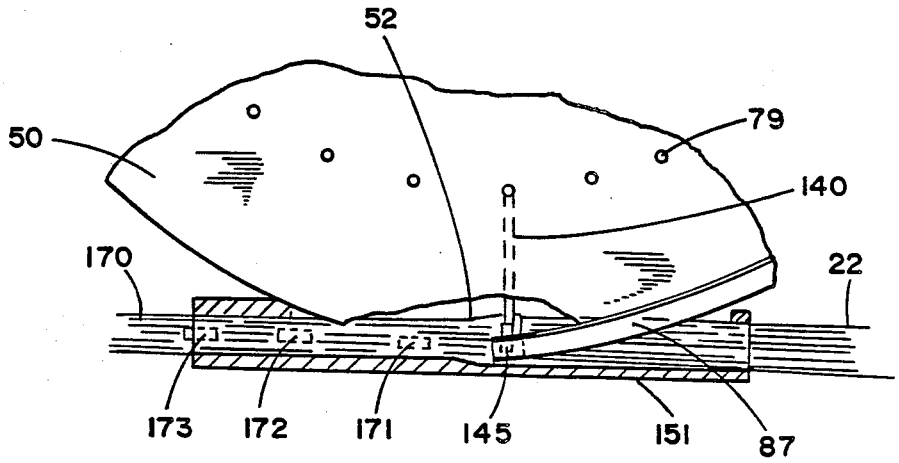
FIG. 8 is a partial sectional view of a portion of the pellet insertion unit showing placement of the pellet from a groove of the rotating wheel into the continuous web of fiber tow.

Referring to FIG. 8, the plow 87 and wheel 50 extend into the block 151 (shown as a cut away sectional view) and into the web of filter material 22. The pellet 145 is ejected from groove 52 (a portion of wheel 50 is cut away) and into the web near the point at which the plow no longer acts as a rim over the peripheral face of the wheel. In such a manner, a series of pellets 145, 171, 172 and 173 are positioned in the web at predetermined intervals within the cylindrical composite 170 which exits block 151 into a gathering means such as a tongue (not shown).

Referring again to FIG. 1, filter material 22 is supplied and is passed into the rod forming unit 14. For example, filamentary tow such as cellulose acetate is processed using a conventional filter tow processing unit such as a commercially available E-60 supplied by Arjay Equipment Corp., Winston-Salem, N.C. A portion of such an apparatus is designated by reference numeral 26 in FIG. 1. Normally a plasticizer such as triacetin is applied to the filamentary tow using known techniques.

The continuous length of filter material 22 is pulled through the block 151 by the action of the rod forming unit 14 and the individual pellets are inserted at predetermined intervals within the web of filter material. The filter material is further directed into a gathering means 180 of the rod forming unit 14. The gathering means can have a tongue and horn configuration, a gathering funnel configuration, stuffer or transport jet configuration, or the like. The tongue 180 provides for further gathering, compaction, conversion or formation of the cylindrical composite from block 151 into an essentially cylindrical (i.e., rod-like) shape whereby the continuously extending stands or filaments of the filter material extend essentially along the longitudinal axis of the cylinder so formed.

The filter material which has been compressed into a cylindrical composite is received into the rod-forming unit 14. The cylindrical composite is fed into wrapping mechanism 182 which includes endless garniture conveyer belt 184 or other garniture means. The garniture conveyer belt 184 is continuously and longitudinally advanced using advancing mechanism 186 such as a ribbon wheel or cooperating drum so as to transport the cylindrical composite through wrapping mechanism 182. The wrapping mechanism provides a strip of wrapping material 188 to the outer surface of the cylindrical composite in order to produce continuous wrapped rod 30.

The strip of wrapping material 188 is provided from rotatable bobbin 190. The wrapping material is drawn from the bobbin, is trained over a series of guide rollers, passes under block 151, and enters the wrapping mechanism 182 of the rod-forming unit. The endless garniture conveyer belt 184 transports both the strip of wrapping material and the cylindrical composite in a longitudinally extending manner through the wrapping mechanism 182 while draping or enveloping the wrapping material about the cylindrical composite. The seam formed by an overlapping marginal portion of wrapping material has adhesive (e.g., hot melt adhesive) applied thereto at applicator region 195 in order that the wrapping material can form a tubular container for the filter material. The adhesive can be cooled using chill bar 198 in order to cause rapid setting of the adhesive. It is understood that various other sealing means and other types of adhesives can be employed in providing the continuous wrapped rod.

The continuous wrapped rod 30 passes from the sealing means and is subdivided (e.g., severed) at regular intervals at the desired, predetermined length using cutting assembly 32 which includes as a rotary cutter, a highly sharpened knife, or the like. It is particularly desirable that the cutting means not flatten or otherwise adversely affect the shape of the rod. The rate at which the cutting assembly severs the continuous rod at the desired points is controlled relative to the rate at which the pellets are inserted into the continuous web of filter material. In particular, the cutting assembly is geared in a direct drive relationship to the drive assembly of the rod-making apparatus. A suitable manner for providing the required timing for severing the continuous rod at the desired length and with the desired number of pellets positioned at the predetermined intervals therein will be apparent to the skilled artisan.

The succession or plurality of rods 34 are collected for use in collection means 38 which is a tray, a rotary collection drum, or the like. If desired, the rods can be transported directly to a cigarette making machine. In such a manner, in excess of 1,400 rods, each of about 100 mm length, can be manufactured per minute.

The filter material can vary and is any material which can be employed in providing a tobacco smoke filter for cigarettes. Especially preferred is filamentary tow such as cellulose acetate, polypropylene, or the like. For example, cellulose acetate tow having 3 denier per filament and 35,000 total denier can provide a suitable filter rod. As another example, cellulose acetate tow having 8 denier per filament and 40,000 total denier can provide a suitable filter rod.

The continuous strand is most preferably a plasticized material. Most preferably the continuous strand is provided from a thermoplastic material such as polyethylene, polypropylene, nylon, or the like. Typically, the strand consists principally of or consists essentially of high density polyethylene material having a generally circular cross section of about 2.5 mm diameter. Examples of suitable strands are those strands which contain flavors and are available from Applied Fragrance Technologies, Inc., Mount Olive, N.J. For example, a suitable strand having a circular cross section of 2.5 mm diameter, and containing high density polyethylene and menthol flavorant is obtained from Applied Fragrance Technologies, Inc., as Experimental Strand 4-53A.

The strand most desirably has a consistency such that the pellet insertion apparatus of this invention can efficiently and effectively form pelletized material from the strand. For this reason, a material having a plasticized character is desirable. In particular, the strand should not be so resilient that handling is difficult, or the interaction of ledger housing and wheel cannot cut the strand to a pelletized form. Furthermore, the preferred strand should not be so brittle that undesirable chipping or shattering of the strand and/or pellet occurs during the pellet formation steps. However, the strand should have a fairly hard character in order to allow for efficient cutting or shearing of the strand to form the pellets. For example, it is highly desirable that the strand not be so soft such that the strand does not cut cleanly. In particular, overly soft strands may provide pellets having undesirable thin fibrous strands or "hairs" formed during the shearing operations.

The size and shape of the pellet can vary. Generally, the pellet has a generally cylindrical shape. Preferably, the pelletized material is of a size such that each individual pellet can be positioned within the filter element of a cigarette without providing negative properties to the smoking article. For example, it is desirable that the pellet not (i) stick out of the mouthend of the filter element or be otherwise visible; (ii) be so large that the draw resistance of the smoking article be undesirably affected; or (iii) provide an undesirable weight or feel to the smoking article. A suitable pellet for use in a filter element having a length of about 27 mm and a circumference of about 24.5 mm has a substantially cylindrical shape with a length of about 2.5 mm and diameter of about 2.5 mm.

Most preferable strands (and hence the resulting pelletized material) act as substrates for carrying or containing smoke modifying agents such as flavorants, salivators, or the like. The amount of smoke modifying agent carried or contained by an individual pellet depends upon the properties and characteristics of the smoke modifying agent, the characteristics of the polymer system substrate, the surface area of the pellet, the desired delivery of smoke modifying agent, and other such factors.

Figure 9:
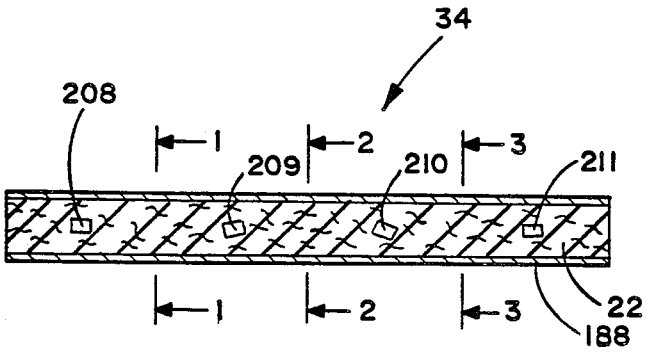
FIG. 9 is a longitudinal sectional illustration of a filter rod including filter material and pelletized material positioned at predetermined and controlled intervals therein.

Referring to FIG. 9, filter rod 34 generally can be further subdivided into cylindrical shaped filter elements using techniques as are known by the skilled artisan familiar with conventional cigarette manufacturing. The filter rod 34 includes filter material 22 encased in circumscribing wrapping material 188 such as conventional air permeable or air impermeable paper plug wrap, or other suitable wrapping material. As an example, four pellets 208, 209, 210 and 211 are individually spaced at predetermined intervals within the rod 34. In particular, each of the pellets are positioned along the rod in a spaced apart relationship from one another. As shown by lines 1—1, 2—2 and 3—3, respectively, the rod can be used as a "four up" rod to provide four filter elements. Other configurations such as the so called "six up" rods also can be manufactured. Rod sizes for use in the manufacture of filter elements for cigarettes can vary, but typically range in length from about 80 mm to about 140 mm, and from about 16 mm to about 27 mm in circumference. For example, a typical rod having a 100 mm length and a 24.53 mm circumference exhibits a pressure drop of from about 200 mm to about 400 mm of water as determined at an airflow rate of 17.5 cc/sec. using an encapsulated pressure drop tester, sold commercially as Model No. FTS-300 by Filtrona Corporation.

Figure 10:
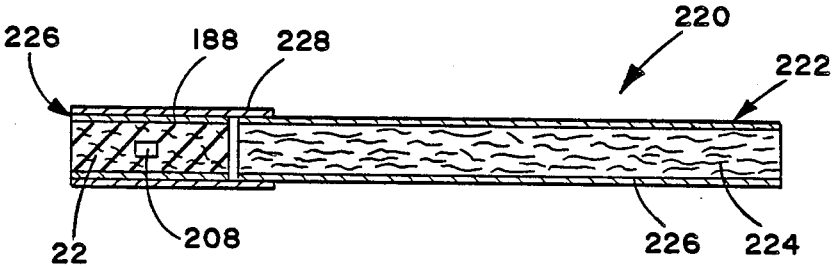
FIG. 10 is a longitudinal cross sectional illustration of a cigarette having a rod of smokable material, and an axially aligned filter element having a pellet positioned therein.

Referring to FIG. 10, smoking article 220 has the form of a cigarette. The article 220 includes rod 222 including smokable material such as tobacco cut filler 224, or the like, contained in circumscribing wrapping material 225 such a conventional cigarette paper wrap. The ends of the rod are open to expose the smokable material. Generally, the length of the rod 222 ranges from about 55 mm to about 85 mm. The smoking article further includes filter element 226 positioned adjacent one end of rod 222 such that the filter element is aligned with the rod in an end-to-end relationship. Filter element 226 has a cross sectional shape similar to that of rod 222. The filter element 226 is provided from filter rod, the previously described filter rod and includes filter material 22, circumscribing plug wrap 188 and an individual pellet 208. The pellet 208 is a solid mass positioned within the filter element such that the pellet cannot be observed by visual inspection of the extreme mouthend of the cigarette. For example, the pellet is centrally located longitudinally within the filter rod. The filter element 226 is attached to the rod 222 by tipping material 228 which circumscribes both the filter element and an adjacent region of the rod. The inner surface of the tipping material 228 is fixedly secured (e.g., using an adhesive) to the outer surface of the filter element 226 and to the wrapping material 225 of an adjacent region of the rod 222. The tipping material 228 circumscribes the rod 222 over a longitudinal length which can vary but is typically that length sufficient to provide good attachment of the filter element to the rod. The tipping material can be a conventional air permeable or air impermeable tipping paper. The cigarette can be equipped with air dilution perforations or other means for providing air dilution thereto, if desired. It is understood that more than one individually placed pellet can be positioned within the filter element, if desired.

Smoke modifying agents which are carried or contained by the pellets include flavorants such as menthol, cinnamon, citrus, cocoa, licorice, tobacco extract, nicotine, and the like. For example, a typical filter element can contain one pellet containing from about 1 to about 10 percent of menthol, based on the total weight of the pellet. The use of flavor-containing pellets in filter elements of smoking articles provides for a well controlled application of desirable ingredients such as flavors into the smoking article. Of particular interest is the fact that certain materials can provide a continuous, controlled release of certain ingredients over time. In addition, the level of flavorant delivered to the user can be well controlled, as when the flavorant is entrained in the mainstream aerosol during draw. As the flavorants are delivered to an appreciable degree from the filter element of the smoking article, a relatively large amount of flavorant is not subjected to the high temperatures experienced in other regions of the smoking article (e.g., in the tobacco rod). In addition, the filter element is capable of modifying (e.g., flavoring) the aerosol delivered by a smoking article without the necessity of noticeably affecting the appearance or structure of the smoking article.

What is claimed is:

1. An apparatus for providing rods for use in the manufacture of smoking articles, each rod having solid masses individually spaced at predetermined intervals along the length thereof, the apparatus comprising:

(a) means for providing a continuous supply of rod filler material;

(b) means for continuously forming individual solid masses in pelletized form from a continuous strand of plasticized material, such means including a rotatable member having a series of pockets positioned at predetermined intervals along the periphery thereof and retaining means which extends over the peripheral face of the rotatable member and which allows for introduction of the continuous strand to successive pockets along the periphery of the rotatable member; the rotatable member and the retaining means being arranged such that the interaction thereof causes the continuous strand to be sheared to form a solid mass within each pocket;

(c) means for positioning the individual solid masses of pelletized plasticized material within the supply of filler material;

(d) means for forming a continuous rod having the individual solid masses positioned at predetermined intervals with the rod; and (e) means for subdividing the continuous rod at predetermined intervals.

2. The apparatus of claim 1 wherein the means for providing a continuous supply of rod filler material is a means for supplying a continuous web of filter material, and wherein the means for continuously inserting the individual solid masses at predetermined intervals within the web of filter material includes (i) a means for forming individual solid masses in pelletized form from a continuous strand of plasticized material and (ii) a means for positioning the individual solid masses of pelletized material within the web of filter material.

3. The apparatus of claim 2 wherein the means for supplying the continuous web of filter material is a tow processing unit.

4. The apparatus of claim 2 further including means for assuring deposit of each individual solid mass within the web of filter material.

5. The apparatus of claims 1 or 2 comprising means for providing a circumscribing outer wrap for the continuous rod.

6. The apparatus of claims 1, 2 or 3 wherein each pocket is generally wedge-shaped, each pocket having (i) a depth which extends from shallow to its deepest portion along the peripheral length of the pocket, and (ii) an abrupt surface extending from the deepest portion thereof towards the periphery of the rotatable member.

7. An apparatus for providing filter rods for use in the manufacture of smoking articles, each filter rod having pelletized material spaced therewithin at predetermined intervals along the length thereof, the apparatus comprising:

(I) means for supplying a continuous web of filter material from a source of filter material;

(II) means for supplying a continuous strand which is employed to provide the pelletized material;

(III) pellet insertion means for continuously forming pellets from the strand and inserting the individual pellets at predetermined intervals within the web of filter material; wherein (a) the pellet insertion means includes (i) a circular rotatable member having a series of pockets positioned at predetermined intervals along the periphery thereof, and (ii) a retaining means including a strand inlet means for allowing introduction of the strand to successive pockets along the periphery of the circular rotatable member; and (b) the circular rotatable member and retaining means are arranged such that (i) the interaction thereof causes the strand to be subdivided into pelletized form within each individual successive pocket, and (ii) the individual pellets are maintained within the respective pockets until each pellet is deposited within the web of filter material;

IV. means for controlling the rate of supply of strand, the rate of rotation of the circular rotatable member, and the rate of supply of filter material such that the pellets are positioned at predetermined intervals within the web of filter material;

V. means for receiving the filter material and positioned pellets into a rod-making means for providing a continuous filter rod; and VI. means for subdividing the continuous rod at predetermined intervals into the desired length thereby forming filter rods such that the desired number of individual pellets are positioned at the desired positions within the filter rods.

8. The apparatus of claim 7 wherein the retaining means has the form of a plow in the region where each individual pellet is deposited within the web of filter material.

9. The apparatus of claim 7 comprising means for providing a circumscribing outer wrap for the continuous rod.

10. The apparatus of claims 7, 8 or 9 wherein the means for supplying the continuous web of filter material is a tow processing unit.

11. The apparatus of claim 10 wherein each pocket is generally wedge-shaped, each pocket having (i) a depth which extends from shallow to its deepest portion along the peripheral length of the pocket, and (ii) an abrupt surface extending from the deepest portion thereof towards the periphery of the rotatable member.

12. The apparatus of claim 7 further including means for assuring deposit of each individual pellet within the web of filter material.

13. The apparatus of claims 7, 8 or 9 wherein each pocket is generally wedge-shaped, each pocket having (i) a depth which extends from shallow to its deepest portion along the peripheral length of the pocket, and (ii) an abrupt surface extending from the deepest portion thereof towards the periphery of the rotatable member.

14. A process for manufacturing rods for use in the manufacture of smoking articles, each rod having solid masses individually spaced at predetermined intervals along the length thereof, the process comprising:

(a) continuously supplying rod filler material;

(b) continuously forming individual solid masses in pelletized form from a continuous strand of plasticized material by introducing the continuous strand into successive pockets along the periphery of a rotatable member and shearing the strand by the interaction of the rotatable member with a retaining means so as to provide a pellet within each pocket; maintaining each pellet in each pocket by the arrangement of the rotatable member with the retaining means; and positioning the individual solid masses of pelletized material within the supplied filler material;

(c) forming a continuous rod having the individual solid masses positioned at predetermined intervals within the rod; and (d) subdividing the continuous rod at predetermined intervals.

15. The process of claim 14 whereby a continuous web of filter material is supplied as rod filler material, and whereby the individual masses are continuously inserted at predetermined intervals within the supplied web of filter material by forming individual solid masses in pelletized form from a continuous strand of plasticized material, and positioning the individual solid masses of pelletized material within the supplied filler material.

16. The process of claim 15 whereby the continuous web of filter material is supplied using a tow processing unit.

17. The process of claims 14 or 15 whereby a circumscribing outer wrap is provided to the continuous rod.

18. A process for providing filter rods for use in the manufacture of smoking articles, each filter rod having pelletized material spaced therewithin at predetermined intervals along the length thereof, the process comprising:

(I) supplying a continuous web of filter material from a source of filter material;

(II) supplying a continuous strand which is employed to provide the pelletized material;

(III) continuously forming pellets from the continuous strand by continuously introducing the strand into successive pockets along the periphery of a rotatable member and shearing the strand so as to provide a pellet within each pocket by the interaction of the rotatable member with a retaining member, which retaining member allows for introduction of the continuous strand into successive pockets along the periphery of the rotatable member;

(IV) maintaining each pellet in each pocket by the arrangement of the rotatable member with the retaining means;

(V) inserting at predetermined intervals the individual pellets from within each successive pocket to within the web of filter material;

(VI) receiving the web of filter material having the individual pellets positioned at predetermined intervals therein into a rod making means and making a continuous rod therefrom; and (VII) subdividing the continuous rod at predetermined intervals into the desired length thereby forming filter rods such that the desired number of individual pellets are positioned at the desired positions within the filter rods.

19. The process of claim 18 whereby a circumscribing outer wrap is provided to the continuous rod.

20. The process of claim 18 or 19 whereby the continuous web of filter material is supplied using a tow processing unit.

21. The process of claim 18 whereby each pellet is provided from a continuous strand of plasticized material.

22. The process of claim 18 whereby the rate of rotation of the rotatable member and the rate of supply of the continuous strand are synchronized with respect to the rate at which the web of filter material is supplied.

23. An apparatus for providing rods for use in the manufacture of smoking articles, each rod having individual masses spaced at predetermined intervals along the length thereof, the apparatus comprising:

(a) means for providing a continuous supply of rod filler material;

(b) means for supplying a continuous strand of material, (c) means for cutting the continuous strand into individual masses, such means including (i) a rotatable member having a series of pockets positioned at predetermined intervals along the periphery thereof, and (ii) retaining means including a strand inlet means for allowing introduction to successive pockets along the periphery of the rotatable member; the rotatable member being secured for rotation within the retaining means, and the rotatable member and retaining means being arranged such that the interaction thereof during rotation of the rotatable member causes the strand to be subdivided into an individual mass within each pocket;

(d) means for depositing each individual mass at predetermined intervals within the supply of filler material;

(e) means for forming a continuous rod having the individual masses positioned at predetermined intervals along the rod; and (f) means for subdividing the continuous rod at predetermined intervals.

24. The apparatus of claim 23 wherein the means for providing a continuous supply of rod filler material is a means for supplying a continuous web of filter material.

25. The apparatus of claim 24 wherein the means for supplying the continuous web of filter material is a tow processing unit.

26. The apparatus of claim 24 comprising the means for providing a circumscribing outer wrap for the continuous rod.

27. The apparatus of claim 24 wherein the rate of rotation of the rotatable member and the rate of supply of continuous strand are synchronized with respect to the rate at which the web of filter material is supplied.

28. The process of claim 24 further including means for assuring deposit of each individual mass within the web of filter material.

29. The apparatus of claims 23, 24, 25, 26, 27, or 28 wherein each pocket is generally wedge-shaped, each pocket having (i) a depth which extends from shallow to its deepest portion along the peripheral length of the pocket, and (ii) an abrupt surface extending from the deepest portion thereof towards the periphery of the rotatable member.

* * * * *